US005853129A

United States Patent [19]

Spitz

[11] Patent Number: 5,853,129

[45] Date of Patent: Dec. 29, 1998

[54] SPRAY NOZZLE

[76] Inventor: Albert W. Spitz, 437 N. Sterling Rd., Elkins Park, Pa. 19027

[21] Appl. No.: 823,475

[22] Filed: Mar. 25, 1997

[51] Int. Cl.[6] ..... B05B 1/26

[52] U.S. Cl. ..... 239/456; 239/501

[58] Field of Search ..... 239/501, 456, 239/581.2, 524, 520

[56] References Cited

U.S. PATENT DOCUMENTS

| | | | |
|---|---|---|---|
| Re. 23,413 | 10/1951 | Bete | 299/121 |
| 664,893 | 1/1901 | Petersonn | 239/456 |
| 1,005,094 | 10/1911 | Wood et al. . | |
| 1,081,275 | 12/1913 | Nickol | 239/581.2 |
| 1,549,537 | 8/1925 | Hansen | 239/501 |
| 1,980,460 | 11/1934 | White | 239/456 |
| 2,612,407 | 10/1952 | Bete | 299/136 |
| 2,736,608 | 2/1956 | Martin | 299/136 |
| 3,938,743 | 2/1976 | Miller | 239/457 |
| 4,510,993 | 4/1985 | Luetzelschwab | 166/75 |
| 4,514,291 | 4/1985 | McGarry et al. | 239/501 X |
| 4,796,816 | 1/1989 | Khinchuk | 239/501 |
| 4,976,404 | 12/1990 | Ichikawa et al. | 251/121 |

FOREIGN PATENT DOCUMENTS

| | | |
|---|---|---|
| 59345 | 9/1922 | Sweden . |

*Primary Examiner*—Kevin Weldon
*Attorney, Agent, or Firm*—Synnestvedt & Lechner

[57] ABSTRACT

A spray nozzle is disclosed including a valve body with a water inlet and outlet and a helical spray vane at the valve body outlet. A tapered plug carried by the valve stem, corresponding in shape to that of the interior of the helical spray vane, moves with the valve stem to decrease the area of the outlet and thereby reduce the discharge flow rate into the helical spray vane. At the same time, the tapered plug moves into the interior of the helical spray vane, causing a reduction in size of a passage formed between the tapered plug and the interior of the helical spray vane. This reduced passage size serves to maintain the velocity of the fluid as it is directed to the active surface of the helical spray vane, thereby substantially maintaining the size of particles produced by the helical spray vane.

12 Claims, 3 Drawing Sheets

SPRAY NOZZLE

BACKGROUND OF THE INVENTION

1. Field of the Invention

The present invention relates to new and useful improvements in spray nozzles and more particularly to improvements in Bete type spray nozzles such as shown in U.S. Pat. No. 2,612,407 and U.S. Pat. No. Re. 23,413 issued to J. U. Bete.

2. Description of the Prior Art

Spray nozzles are widely employed in many fields for many different uses. Examples of spray nozzles of the type employed in the present invention are the above mentioned Bete patents. These nozzles are of relatively simple and inexpensive construction with no moving parts and are extremely durable. They do have, however, one serious limitation in that their turn-down ratio is limited. At maximum flow, they produce a desired fine droplet size spray. This is desirable in most all applications. When the rate of flow through these nozzles is decreased, however, the droplet size increases, decreasing the effectiveness of the spray. This is because the nozzle relies on the rapid flow of liquid over an active surface of a helical vane to form the droplets. As the rate of flow decreases, the velocity of the liquid passing over the active surface of the helical vane decreases, causing an increase in size of the droplets.

It is necessary when using a spray nozzle to cool a gaseous stream, for example, to maintain a fine droplet size at all rates of flow to obtain effective cooling. There are several reasons for this. First, the finer the droplet size, the more rapidly the liquid will evaporate for cooling purposes, because the finer droplets result in more surface area available for evaporation. Additionally, with a larger droplet size, the droplet can impinge upon the walls of the passage through which the gas being cooled is passing; this can cause the liquid to collect in the passage without evaporating, and can also cause eroding of the walls of the passage.

Two basic methods are employed in current spray nozzles to vary the flow of liquid while maintaining a fine droplet size. The first method involves the use of a continuous stream of compressed air for atomizing the liquid. The compressed air is introduced into the nozzle via a separate connection. The liquid flow can then be modulated using a standard valve. Although effective, this method is expensive, requiring the use of one or more air compressors.

The second method involves the use of several banks of nozzles, all designed to operate at the desired droplet size. To control the spray, one or more of the banks are simultaneously operated, the precise number being operated dependant upon the desired output. Precise control of the water flow and cooling is practically impossible because of the "stepped" nature of control.

With the foregoing in mind, it is a primary object of the present invention to provide a spray nozzle of the Bete type which has a high turn-down ratio without adversely affecting the droplet size.

It is a further object of the present invention to provide a spray nozzle wherein the velocity of the liquid flowing over the droplet forming surface is maintained relatively constant as the rate of flow of liquid through the spray nozzle decreases.

Another object of the present invention is to provide a spray nozzle of this type which can be controlled with an automatic actuator, either pneumatically, hydraulically, or electrically, responding to conditions in the gas stream downstream of the spray nozzle to alter operation of the spray nozzle.

A still further object of the present invention is to provide a spray nozzle having the features and characteristics set forth above, which is of simple construction and can be manufactured easily and economically.

SUMMARY OF THE INVENTION

The present invention provides an improved spray nozzle incorporating a conventional helical vane of uniformly decreasing diameter in the direction of flow, which provides the droplet forming surface, together with a tapered plug which is moved inwardly into the vane in the direction of flow to decrease the flow rate. The inlet pressure to the spray nozzle remains substantially constant. The tapered plug serves to decrease the liquid flow area, thereby decreasing the flow rate while maintaining a desired velocity. Since the velocity of flow is maintained substantially constant, the size of droplets formed by the nozzle also remains substantially constant. The plug may be positioned manually or by an automatic actuator.

DETAILED DESCRIPTION OF THE INVENTION

Figure 1:
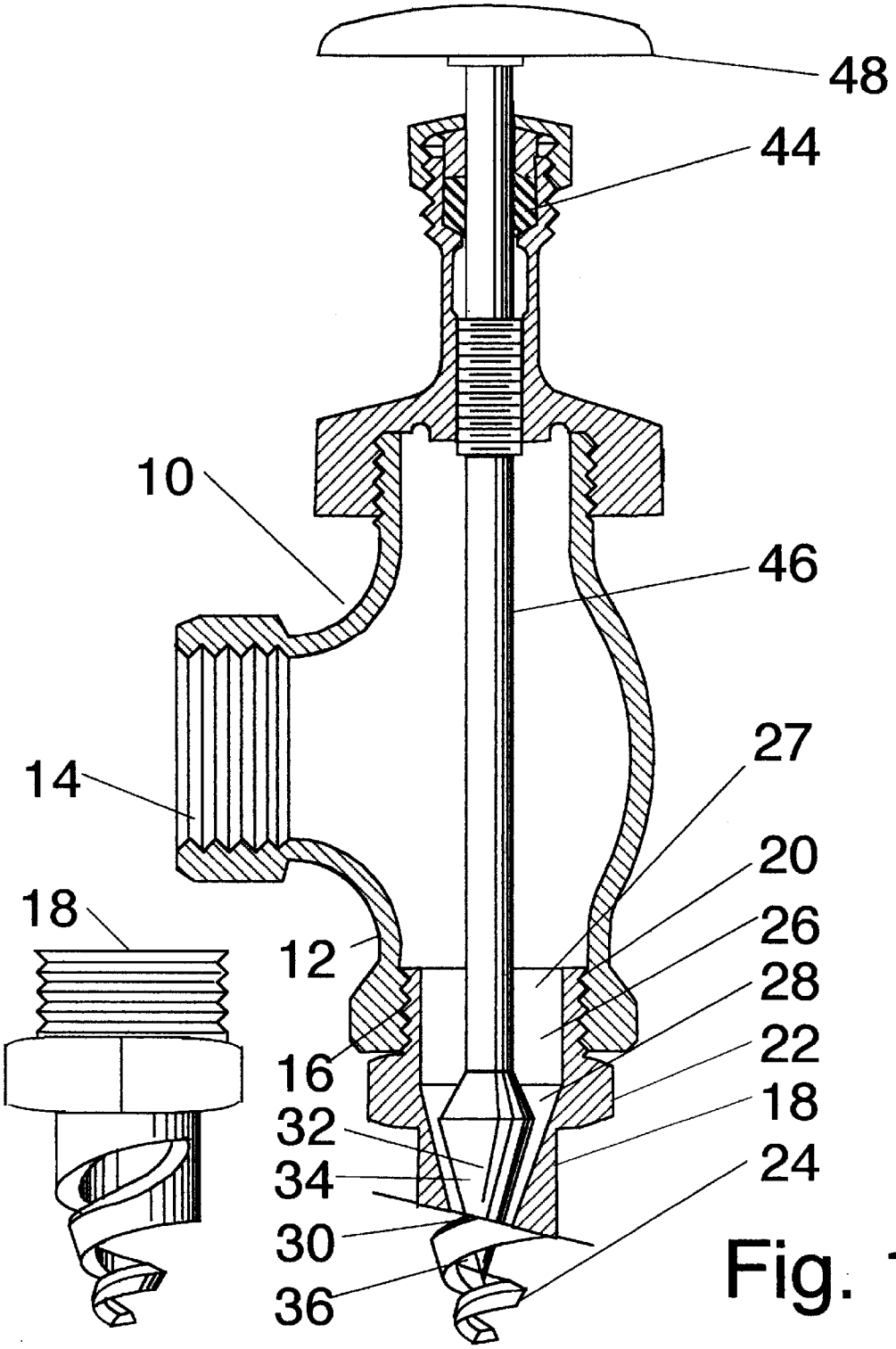
FIG. 1 is a longitudinal sectional view of the spray nozzle of the present invention with a manually operated nozzle.
Figure 2:
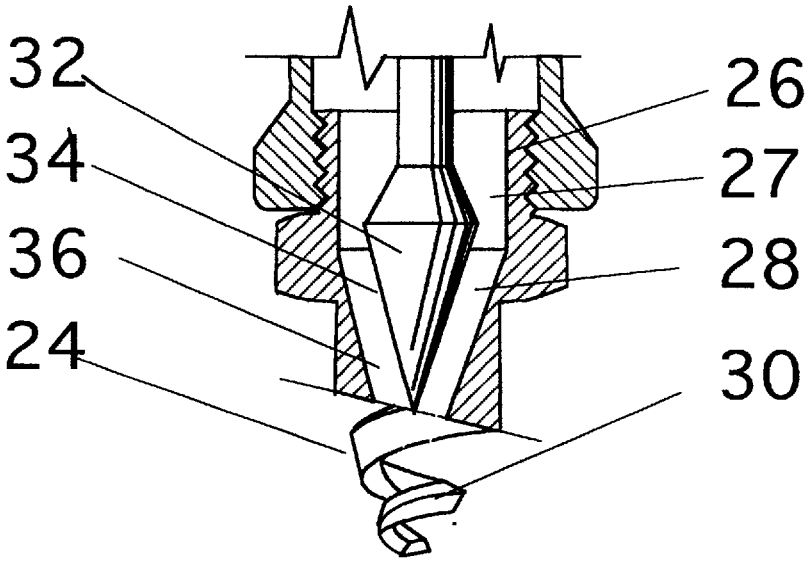
FIG. 2 is an enlarged longitudinal sectional view of the spray nozzle in a fully opened position.
Figure 3:
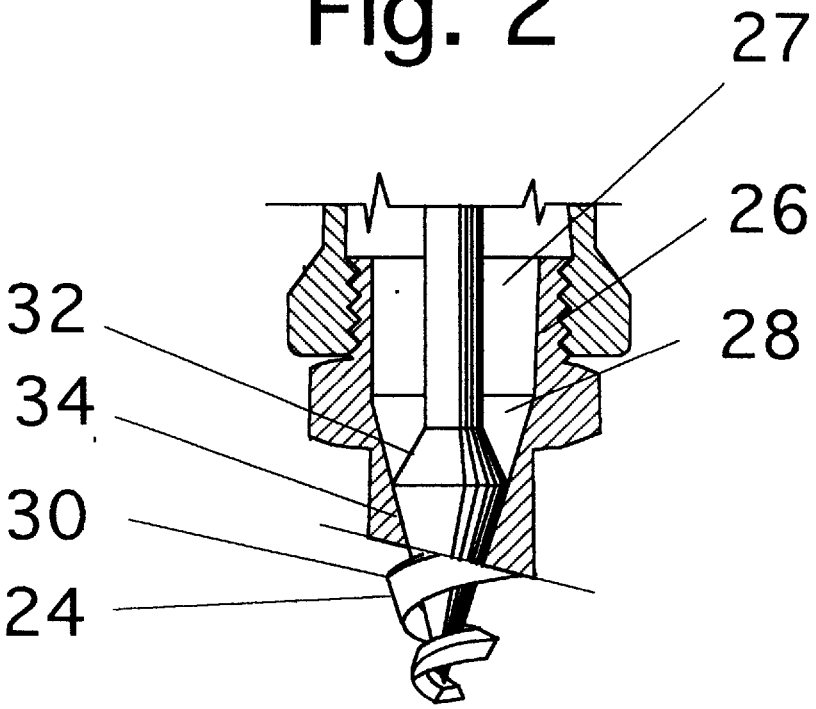
FIG. 3 is an enlarged longitudinal sectional view of the spray nozzle in a fully closed position.

Referring more specifically to the drawings, and particularly FIGS. 1–3, the spray nozzle assembly 10 of the present invention includes a valve body 12 having a liquid inlet 14 and an outlet 16. Secured within the outlet 16 is a helical spray vane nozzle 18 which, in the present instance, has a threaded base portion 20 adapted to be received within the threaded outlet 16 of the valve body 12. The helical spray vane nozzle 18 can be secured to the valve body 12 in any other desired manner such as by flanges and bolts or by welding. In the illustrated embodiment of the present invention, a hex-shaped segment 22 is provided to facilitate threading the helical spray-vane nozzle 18 to the valve body 12. The helical spray-vane nozzle 18 terminates at its outer or downstream end in a conventional helical spray vane 24 similar to that shown and described in the aforementioned U.S. Pat. No. 2,612,407 and U.S. Pat No. Re. 23,413.

A passageway 26 extends longitudinally through the helical spray-vane nozzle and comprises a straight segment 27 of uniform diameter and an inwardly tapered segment 28 adjacent the helical spray vane 24. According to the present invention, the helical spray vane 24 tapers inwardly with the inwardly tapered segment 28 being an extension of the passageway 26. The active surface 30 of the helical spray vane 24 facing toward the passageway exit is inclined downwardly and outwardly from the longitudinal axis of the helical spray vane 24 and serves as the active surface over which the spray liquid flows and is discharged therefrom in the form of a fine conical spray.

An important feature of the present invention is the provision of means to continue a high velocity flow of liquid over the active surface of the vane at all flow discharge rates of the liquid. To this end, a tapered plug 32 is provided which can be moved into the interior of helical spray vane 24 as the flow discharge rate decreases from a full flow to a diminished flow rate. The tapered plug 32 has an outer surface 34 corresponding in shape to that of the interior taper of helical spray vane 24 and is moved inwardly into the helical spray vane 24 to decrease the discharge flow rate of liquid out of the spray nozzle. The inlet pressure to the spray nozzle remains substantially constant. This inward movement of the tapered plug 32 reduces the area between tapered plug 32 and inwardly tapered segment 28, and also narrows the gap 36 between the outer surface 34 of the tapered plug 32 and the surface of the interior taper of the helical spray vane 24; thus, the discharge flow rate is decreased, and the velocity of liquid over the active surface is maintained. By maintaining the high velocity flow over the active surface 30 of the helical spray vane 24 as the discharge flow rate is decreased, a fine droplet spray is produced regardless of discharge flow rate of the liquid.

In the opened position, the tapered plug 32 is withdrawn from the inwardly tapered segment 28, maximizing the area of flow between the tapered plug 32 and the surface of the inwardly tapered segment 28. As the tapered plug 32 is moved inwardly into the helical spray vane 24, the area of flow between the tapered plug 32 and the surface of the inwardly tapered segment 28 is decreased, thereby decreasing the area of the discharge opening into the helical spray vane 28 and reducing the discharge flow rate into helical spray vane 28. At the same time, the size of the gap 36 is narrowed, maintaining the desired velocity of flow over the active surface 30 of the helical spray vane. As the tapered plug 32 is moved outwardly relative to the surface of the inwardly tapered segment 28, the area of flow between the tapered plug 32 and the surface of the inwardly tapered segment 28 is increased, thereby increasing the area of the discharge opening into the helical spray vane 28 and increasing the discharge flow rate into the spray vane 28. At the same time the size of the gap 36 is widened, maintaining the desired velocity of flow over the active surface 30 of the helical spray vane 24.

To control the rate of flow through the spray valve 10, means are provided to move the threaded valve stem 46 longitudinally through the valve body 12. This drive means can be a conventional screw threaded stem 46 with a valve handle 48, as shown, in FIG. 1 or a motor, a hydraulic/pneumatic drive, shown in FIG. 3, which will move the valve stem according to predetermined instructions. Suitable packing means 44 is provided a the entrance of the valve stem 46 to the valve body 12 to prevent leakage of the spray liquid.

With this above construction, it can be seen that the velocity of flow over the active surface 30 of the helical spray vane 24 remains substantially constant throughout a wide range of discharge rates from the valve. Since the size of the droplets formed by the spray liquid leaving the active surface 30 of the helical spray vane 24 depends on the velocity of the spray liquid passing over the helical spray vane 24, droplet size will remain substantially constant over a widely varying rate of discharge.

In the preferred embodiment the spray nozzle does not have to be closeable to a "drip-tight" position. However, if desired, the spray nozzle of the present invention can be rendered drip-tight by including a flared collar area on or near the widest portion of the tapered plug 32 so that, when the tapered plug 32 is fully extended into the inwardly tapered segment 28, the flared collar engages with the top (the widest portion) of the inwardly tapered segment 28. This engagement completely stops the flow of fluid into the tapered segment 28, rendering the spray nozzle drip-tight.

Figure 4:
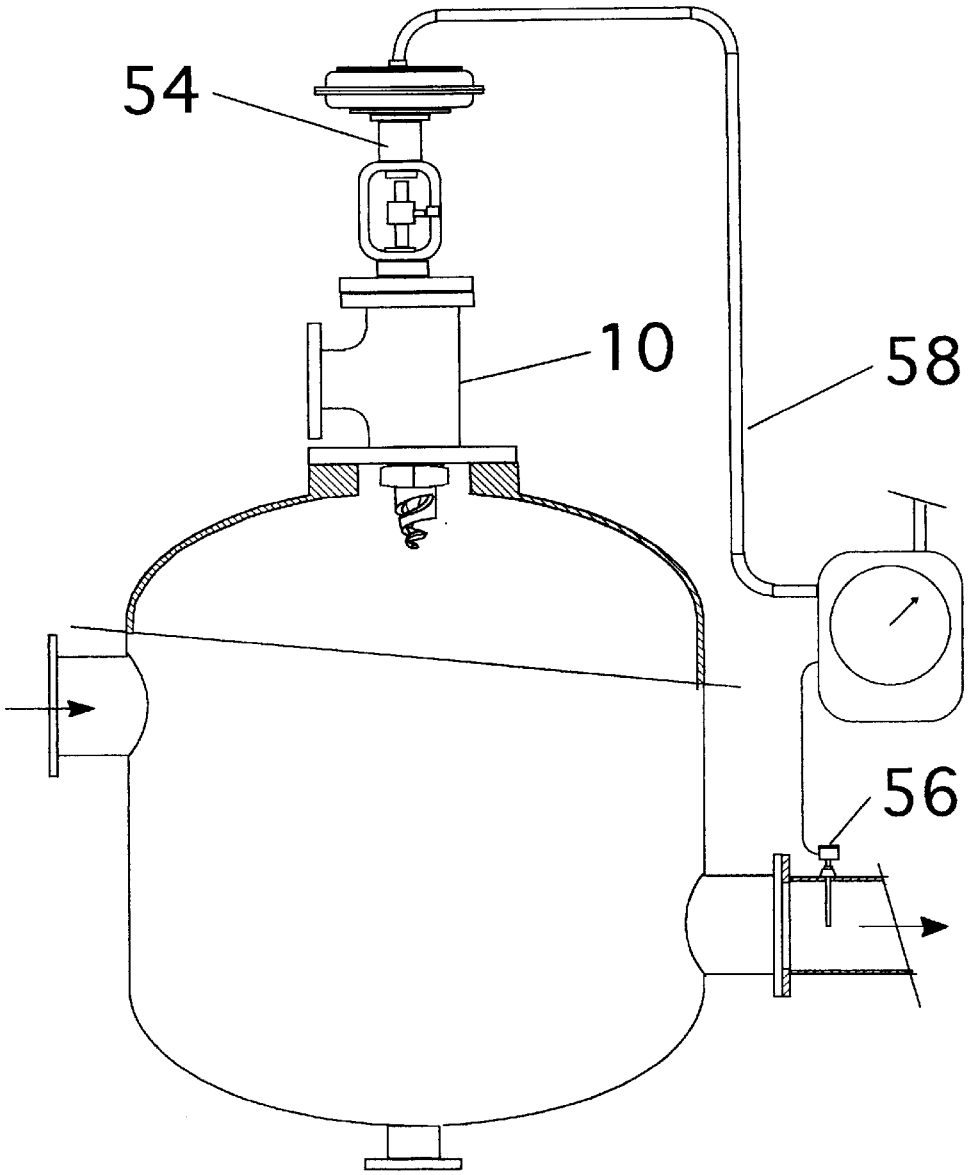
FIG. 4 is a fragmentary view of a cooling chamber with a spray nozzle of the present invention and automatic actuator installed to treat exhaust gasses.

FIG. 4 illustrates a form of the present invention where one or more spray valves 10 are installed in a cooling chamber 50 to treat gasses passing through the chamber. In this instance, the spray valve 10 is mounted in the chamber and an automatic valve actuator 54 secured to the valve 10 is provided to control operation of the valve. In this configuration, gas sensing apparatus such as a thermocouple 56 is provided at the outlet of the cooling chamber and connected by means of a control line 58 to the valve actuator to control the spray in accordance with the temperature of the gasses in the chamber.

While particular embodiments of the present invention have been illustrated and described herein, it is not intended to limit the invention to such a disclosure, and changes and modifications may be incorporated and embodied therein within the scope of the following claims.

What is claimed is:

1. A spray valve for spraying a spray liquid comprising:

a valve body having an inlet and an outlet for the spray liquid;

a valve stem mounted within the valve body for longitudinal movement toward and away from said outlet; and a spray nozzle at the outlet of the valve body, said spray nozzle including a helical spray vane with an inner surface tapering inward away from the outlet; and a tapered plug carried by said valve stem movable into and out of said helical spray vane as said valve stem is moved longitudinally to control the flow of the spray of the liquid.

2. A spray valve in accordance with claim 1 wherein said tapered plug and inner surface of said helical spray vane provide a flow passage for the spray liquid.

3. A spray valve in accordance with claim 2 wherein said flow passage decreases in size as said valve plug is moved into said helical spray vane.

4. A spray valve in accordance with claim 3 wherein said tapered plug and said spray vane are in axial alignment with said valve stem.

5. A spray valve in accordance with claim 1, further comprising actuating means for said valve stem to move said valve stem in the longitudinal direction.

6. A spray valve in accordance with claim 5 wherein said actuating means comprises a threaded valve stem and a manually operated handle.

7. A spray nozzle in accordance with claim 6 wherein said actuating means comprises an automatic valve actuator carried by said valve body.

8. A valve for spraying a spray liquid, comprising:

a valve body having an inlet and an outlet for the spray liquid;

a spray nozzle at the outlet of said valve body, said spray nozzle including an helical spray vane having an inner surface tapering inward in a direction away from said outlet; and a tapered plug moveable longitudinally within said valve into and out of said helical spray vane to control the spray of the spray liquid, said tapered plug having an outer surface tapering inward away from the outlet.

9. A spray nozzle in accordance with claim 8, wherein said outer surface of said tapered plug has a taper corresponding to that of said inner surface.

10. A spray valve in accordance with claim 8 wherein said outer surface of said tapered plug and said inner surface of said helical spray vane define a flow passage for the spray liquid, said flow passage decreasing in size as said valve plug is moved into said helical spray vane.

11. A spray valve in accordance with claim 10, wherein said outer surface of said tapered plug has a taper corresponding to that of said inner surface.

12. A spray valve in accordance with claim 1 wherein said tapered plug has an exterior surface tapering inward away from said outlet.

* * * * *